US006591912B2

(12) United States Patent
Ross et al.

(10) Patent No.: US 6,591,912 B2
(45) Date of Patent: Jul. 15, 2003

(54) FULL BORE AUTOMATIC GUN RELEASE MODULE

(75) Inventors: Colby W. Ross, Houston, TX (US); William D. Myers, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/002,791

(22) Filed: Nov. 15, 2001

(65) Prior Publication Data

US 2002/0100586 A1 Aug. 1, 2002

Related U.S. Application Data

(60) Provisional application No. 60/248,810, filed on Nov. 15, 2000.

(51) Int. Cl.[7] ..... E21B 43/11

(52) U.S. Cl. ..... 166/297; 166/55.1; 166/242.7; 166/212; 166/377; 175/452

(58) Field of Search ..... 166/297, 55.1, 166/242.7, 212, 377; 175/4.52

(56) References Cited

U.S. PATENT DOCUMENTS

| | | | | |
|---|---|---|---|---|
| 4,526,233 A | 7/1985 | Stout | 166/377 |
| 4,611,660 A | 9/1986 | Stout et al. | 166/297 |
| 4,756,363 A | 7/1988 | Lanmon, II et al. | 166/55.1 |
| 4,771,827 A | 9/1988 | Barker et al. | 166/55.1 |
| 4,776,393 A | 10/1988 | Forehand et al. | 166/55.1 |
| 4,790,383 A | 12/1988 | Savage et al. | 166/297 |
| 4,815,540 A | 3/1989 | Wallbillich, III | 166/377 |
| 5,156,213 A | 10/1992 | George et al. | 166/297 |
| 5,293,940 A | 3/1994 | Hromas et al. | 166/297 |
| 5,370,186 A | 12/1994 | Ireland | 166/297 |
| 5,423,382 A | 6/1995 | Barton et al. | 166/297 |
| 5,429,192 A | 7/1995 | Huber et al. | 166/297 |
| 5,509,481 A | 4/1996 | Huber et al. | 166/297 |
| 6,098,716 A | 8/2000 | Hromas et al. | 166/377 |
| 6,148,916 A | 11/2000 | Sampson et al. | 166/297 |

*Primary Examiner*—Hoang Dang
(74) *Attorney, Agent, or Firm*—Madan, Mossman & Sriram, P.C.

(57) ABSTRACT

A perforation gun is secured to the inside bore of a well completion tube by a releasable connection module. The connection module mechanism includes radially expanding anchor dogs that are retained at an expanded position by a latching mechanism that may be released, alternatively, by combustion gas or by wireline. When the perforation gun is discharged, gas from the discharge combustion displaces a retaining piston. Displacement of the retaining piston releases a latch pin and allows the gun weight to shift a secondary release sleeve. Shift of the secondary release sleeve releases a latch dog retention pin and hence, releases the anchor dogs from a meshed connection with the completion tube. The secondary release sleeve may also be shifted by the upward pull of a wireline.

21 Claims, 8 Drawing Sheets

FULL BORE AUTOMATIC GUN RELEASE MODULE

CROSS-REFERENCE TO RELATED APPLICATIONS

Filing priority for this application is based upon U.S. Provisional Application Serial No. 60/248,810 that was filed on Nov. 15, 2000, and for which benefit is hereby claimed.

BACKGROUND OF THE INVENTION

1. Field of the Invention

The present invention relates to the art of well drilling and earth boring. More particularly, the invention relates to methods and apparatus for perforating wellbore casing or casing liner.

2. Description of Related Art

After the actual drilling of a borehole into the earth, the shaft is often prepared for long term fluid production by a series of steps and procedures that are collectively characterized by the art as "completion." Among these numerous procedures is the process of setting a casing, usually steel, within the borehole to line the shaft wall with a stable, permanent barrier. This casement is often secured by cement that is pumped into the annulus between the outside diameter of the casing and the inside diameter of the raw shaft wall.

While the casing stabilizes the shaft wall, it also seals the fluids within the earth strata that have been penetrated by the borehole from flowing into the borehole. The borehole inflow of some of the fluids is the desired objective of making the borehole in the first place. To selectively open the casing to such fluid flow, the casing wall is often penetrated in the region of a production zone by shaped charge explosives or "bullets". Numerous charges or bullets are loaded into tubular "guns", usually in a helical pattern along and around the gun tube axis for positioning within the wellbore at the desired location. The line of discharge from the gun is radial from the gun tube axis.

The downhole environment of a deep earth boring is frequently hostile to the extreme. The borehole is usually filled with a mixture of drilling fluids, water and crude petroleum. At such depths, the bottom hole pressures may be in the order of tens of thousands of pounds per square inch and at hundreds of degrees Celsius temperature. Consequently, by the time the perforating gun arrives at the desired perforation location, the ignition system, the explosives or the propellant charges are sometimes compromised to the extent that discharge fails to occur on command. In anticipation of such contingencies, provision is often made for unrelated alternative firing systems. If all else fails, the defective gun must be withdrawn from the well and repaired or replaced and returned.

As a further consideration, many of the well completion steps require specific tools that are operatively secured within the length of a pipe or tubing work string and deposited into the wellbore from the surface. Placement of a completion tool on downhole location may require many hours of extremely expensive rig time and skilled labor. The full cycle of down hole tool placement and return is termed in the art as "a trip."

At the present state of art, many of the necessary well completion tools are assembled collectively on a single work string and run into the wellbore together for the purpose of accomplishing as many of the several completion steps in as few "trips" as possible. There could be many advantages, therefore, for including the perforation gun at the end of a completion tube. In a single trip, the well could be perforated, fractured, packed and produced. On the negative side, however, should the gun misfire, it would be necessary to withdraw the entire work string to repair or replace the perforation gun.

Comparatively, tools and instruments suspended from drum reeled "wirelines" are run into and out of a wellbore quickly and efficiently. It would be advantageous, therefore, to position, secure, remove and/or replace a perforation gun or other such tool entirely by wireline.

Some completion assemblies connect the gun to the work string in such a manner that releases the spent gun tube to free fall further down the wellbore below the perforated production zone. In some cases, this gun release function may be desirable. In other cases, especially when additional drilling may be contemplated, the spent gun becomes downhole "junk" and must be extracted by a fishing operation.

It is, therefore, an object of the present invention to provide a means and method for securing a perforating gun to the end of a completion or production tube for alternative operational modes. In one mode, the gun may automatically disconnect from the work string when the gun is discharged and free fall from the perforation zone. In another operational mode, the gun may be tethered to a wireline and withdrawn from the well after discharge.

Another object of the invention is provision of a perforation gun assembly that may be lowered into a well along a work string tube bore at the end of a wire line, secured to the tube bore at the desired position and discharged. In the event of malfunction, the gun may, by wireline, be disconnected from the work string tube and withdrawn for repair.

SUMMARY OF THE INVENTION

As an initial description of physical relationships, the perforation gun and its associated tubing connection module are sized to pass internally through the bore of a tubing string suspended within a well bore. Such tubing around the gun may be any number of working string elements such as the tail pipe of a completion string or a production tube for example. Within this control parameter, the connection module preferably comprises two expandable dog connecting mechanisms. The first set of connecting dogs secures the perforating gun to the connection module whereas the second set secures the connection module to the bottom end of the work string tubing.

The first or lower set of connecting dogs are released by gas pressure generated by the perforation propellant. When the gun discharges, propellant gases generate a pressure surge within the bore of the perforating gun which are channeled to act upon one annular end face of a sleeve piston. The sleeve piston is thereby displaced by a resulting pressure differential to align a reduced radius release perimeter along the piston surface under the first dog set. When the release perimeter is aligned with the first connecting dogs, the dogs radially retract from a position of meshed engagement with a circumferential ledge that is formed around the inside perimeter of a cylindrical counterbore in the connection module socket cylinder. Upon radial retraction of the first connecting dogs, the spent gun is free to axially slide along the connection module socket cylinder for a limited distance.

The second or upper set of connecting dogs are expanded into a circumferential latch channel formed around the inside bore of the work string tube. Radially shifting latch pins are caged by a setting piston and externally meshed with a latching cone. Internally, the latch pins are supported by a surface profiled latch tube. A connective relationship between the work string tube and the upper connecting dogs is maintained by shear pins and screws through the upper latch profile tube and the upper latch setting piston.

When the spent gun shifts downwardly, the profiled upper latch tube is pulled down to shear the respective retaining pin and remove the radial support structure under the upper latch pins. Without interior support, the upper latch pins retract radially inward to release the upper connecting dogs from the work string latching channel. When the upper connecting dogs retract from the work string latching channel, the connection module and spent perforating gun are free to fall away from the end of the work string tubing.

In an alternative operational mode, such as when the gun fails to discharge, the upper connecting dogs may be retracted by a wireline pull on the upper latch profile tube. This releases the gun and connection module assembly as a unit from the work string tube. At any time, the unit may be drawn out of the wellbore at the end of the wireline along the work string internal bore, replaced or repaired and returned.

BRIEF DESCRIPTION OF THE DRAWING

For a thorough understanding of the present invention, reference is made to the following detailed description of the preferred embodiments, taken in conjunction with the accompanying drawings in which like reference characters designate like or similar elements throughout the several figures of the drawing. Briefly.

DESCRIPTION OF THE PREFERRED EMBODIMENT

Construction and Assembly

Figure 1:
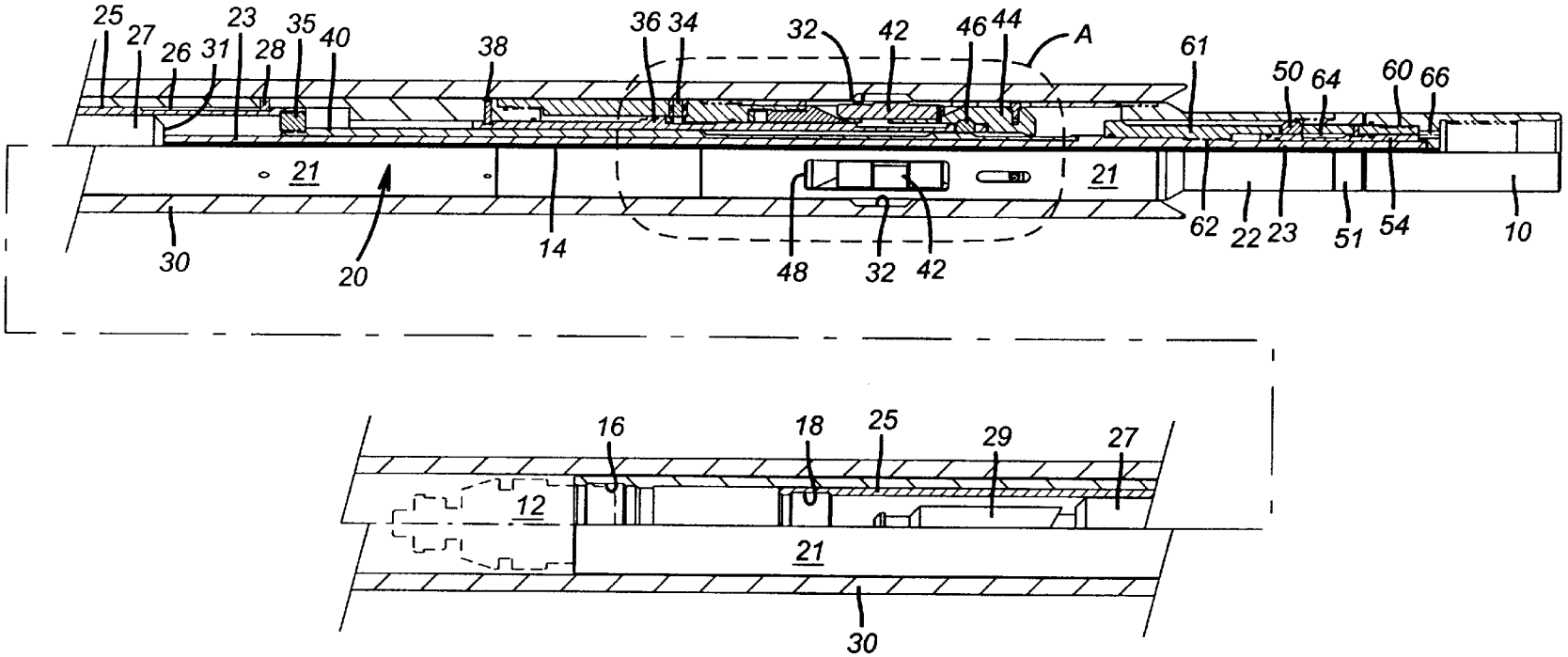
FIG. 1 is a quarter section view of the invention assembly set for in-running down a work string tube at the end of a wireline.

FIGS. 1 through 6 show the invention as a quarter sectioned assembly within a half sectioned work string tube. A connection module 20 structurally links a work string 30 with a perforating gun housing represented here by the gun assembly sub 10. The work string tube 30 may be a completion string tail pipe or a production tube. References herein to "tube" may be to any of these particular tubes without intent to be exclusive. The tubing may be either rigid joints or coiled continuous tube. Although illustrated horizontally, the invention operating environment is normally disposed at some approximation of vertical. Accordingly, the left end of the illustration is normally the upper end of the assembly. Descriptive references to up and down hereafter will be consistent with this orientation.

As an initial description of relative dimensions, it will be noted that the connection module 20 and perforating gun housing 10 preferably are cross-sectionally dimensioned to pass axially along the internal bore of the work string 30 entirely to the surface.

Figure 8:
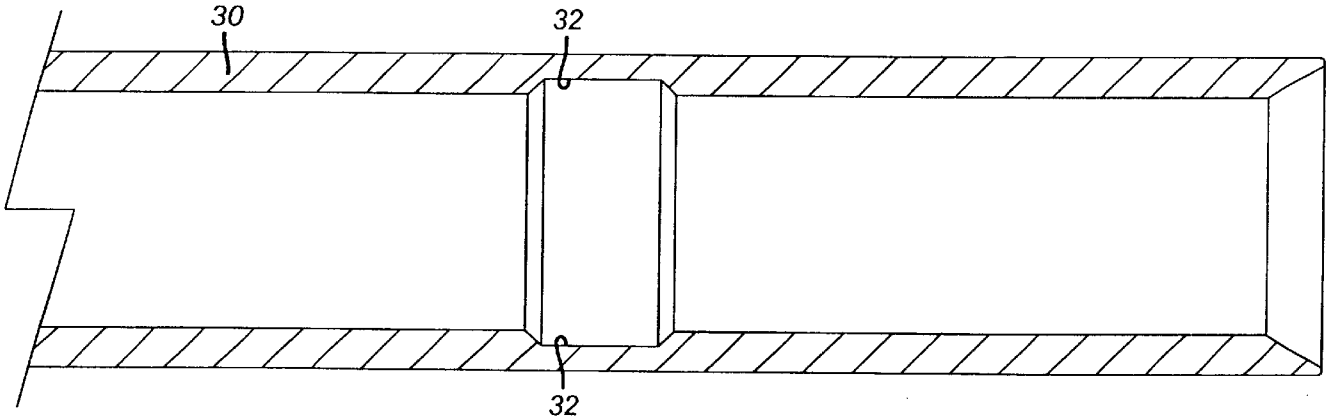
FIG. 8 is a detailed half section of the work string bottom end.

With respect to FIG. 8, the work string 30 to be used with the invention is unique only by the presence of the internal latch channel 32 formed into the internal bore wall of the work string near the bottom end.

The connection module 20 comprises a tubular case wall 21 having a plurality of latch dog windows 48 around the lower perimeter of the case. At the upper end of the outer case wall 21, the inner bore is formed by internal profiles 16 to connect with a wireline setting tool 12.

Figure 9:
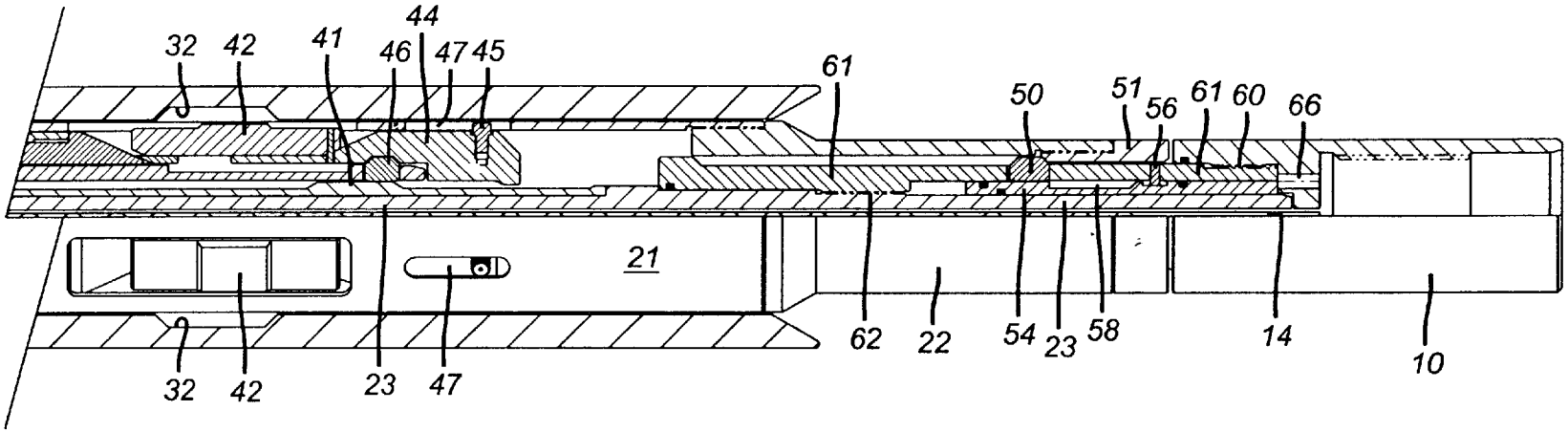
FIG. 9 is an enlarged view of the lower latching assembly.

Referring to the FIG. 9 enlargement, the lower end of the case wall 21 includes a socket cylinder 22. The internal bore of the socket cylinder 22 is threaded at its lower end to receive a latch collar 51. The latch collar 51 profiles a structural support ledge for lower latching dogs 50.

The gun assembly sub 10 is secured by assembly thread 60 to a caging sleeve 61. The caging sleeve 61 is secured by assembly thread 62 to a stinger element 23. A concentric cylinder lap between the lower end of the stinger element 23 and the caging sleeve 61 forms an annular cylinder space within which a lower latch piston 54 translates. A circumferential channel 58 in the outer perimeter of the lower latching piston is sufficiently wide and deep to accommodate radial extraction of the lower latching dogs 50 from a radial engagement with the latch collar 51 when the channel 58 is axially aligned with the base of the latching dogs 50. Under in-running conditions of gun placement, the latching dogs 50 are laterally and circumferentially confined within windows in the caging sleeve 61. Radially, the latching dogs 50 are confined to the expanded position by a shoulder portion of the latching piston 54 when the latching piston is appropriately aligned. The latching piston shoulder portion has a greater diameter than the root diameter of channel 58. In-running, the latching piston 54 support location for the radially expanded position of the latching dogs 50 is secured by shear pins 56.

The upper end of the stinger element 23 is secured to an interventionless firing head (IFH) 27. A detonation cord channel 14 extends from the IFH along the length of the stinger 23 to the gun 10 detonator not shown. Detonation cord ignition occurs in response to pressure pulse signals transmitted along the well fluid from the surface. The detonation cord channel 14 is vented at 66 against the lower ends of the latch piston 54. When the perforating gun is discharged, combustion gas pressure is channeled through the vents 66 against the lower edge of the latch piston 54. This combustion gas pressure displaces the piston 54 to align the channel 58 under the lower latching dogs 50 and allow retraction of the dogs 50 from a meshed engagement with the socket cylinder latch collar 52. When the dogs 50 are retracted from the latch collar 52, weight of the gun 10 axially pulls the stinger 23 down along the socket cylinder bore until the lower shoulder 31 of the IFH engages the annular step of a spacing collar 35.

The spacing collar 35 joins a secondary release sleeve 25 to an upper latch profile tube 40. The latch profile tube 40 has an axially sliding fit over the stinger tube 23. The external surface of the latch tube 40 includes a profiled latching zone 41 having a greater outside diameter than the adjacent tube surface. The internal bore of the release sleeve 25 has a sliding fit over the IFH and a wireline latching profile 18 near its upper end. Proximate of the spacing collar 35, the external surface of the release sleeve is channeled axially by a keyway 26. A retaining pin 28 set in the outer case wall 21 is projected into the keyway 26 to limit axial displacement of the release sleeve 25 without shearing the pin 28.

Figure 7:
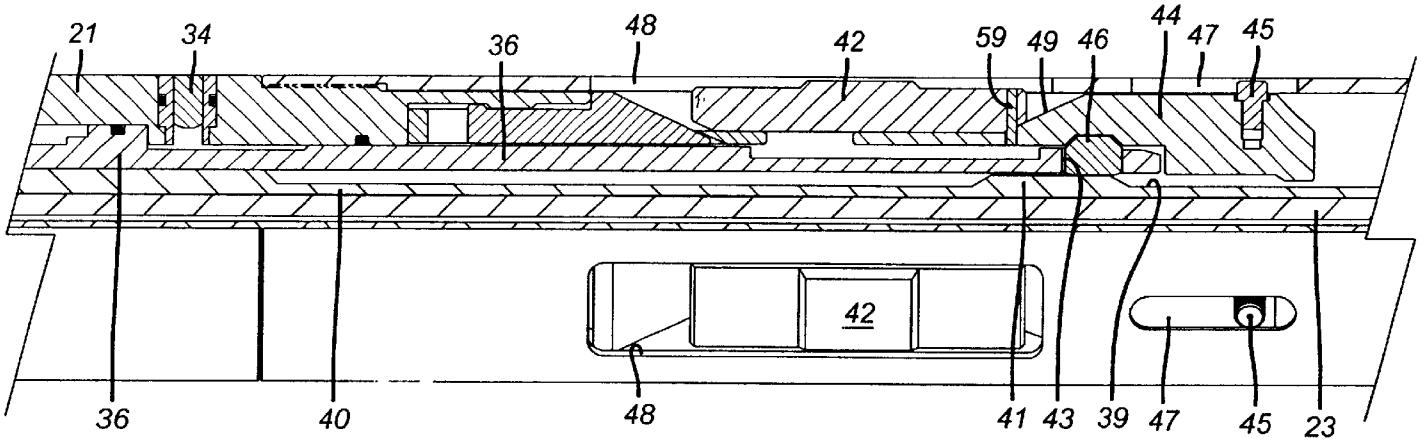
FIG. 7 is an enlarged view of the upper latching assembly within the detail delineation of FIG. 1.

As best illustrated by the enlargement of FIG. 7, the latching zone 41 of the latch profile tube 40 cooperates with upper latch pins 46 to secure an axially firm connection with an upper latch cone 44. Axial displacement of the latch cone 44 is limited by one or more guide pins 45 confined within an axially slotted guide window 47. The upper latch pins 46 are laterally confined within caging windows 43 in an upper setting piston 36. The axial position of the setting piston is secured to the outer case 21 by shear pins 38 for run-in. The setting piston 36 is responsive to wellbore pressure admitted by the opening of a calibrated rupture disc 34. When the wellbore pressure is sufficient, rupture of the disc 34 allows a fluid pressure bias to bear upon the piston 36. Nevertheless, the piston 36 may remain immobile due to the shear strength of the pins 38. However, as the tool continues its descent into a well, the hydrostatic pressure increases proportionally. When the pressure bias on the piston 36 is sufficient, retention pins 38 are sheared thereby allowing the wellbore pressure bias to drive the piston 36 against the latch pins 46. Since the latch pins 46 have a meshed engagement with the latch cone 44, the piston 36 force is translated by the latch pins 46 to the latch cone 44 and finally, to the shear pins 59.

Shear pins 59 secure the relative run-in alignment positions between the latch cone 44 and the upper latching dogs 42. When the pins 59 fail under the wellbore pressure generated force, the latch cone 44 slip face 49 is axially pulled under the upper latching dogs 42 by the setting piston 36 to radially translate the latching dogs 42 out through the latch dog windows 48 and against the inside bore wall of the tube 30. The latching dogs 42 may drag against the inside bore wall as the assembly descends into the well until the upper latching dogs 42 align with the latch channel 32 whereupon the latching dogs 42 engage the channel and anchor the assembly to the tube 30 at this precise point of operation.

The stinger 23 is also connected to an electronic firing head (IFH) 29. The IFH is operative to ignite the detonation cord 14 in response to sonic signals transmitted along the well fluid from the surface. Conveniently, the electronic firing head may be removed and replaced from a downhole location by an appropriate wireline tool. If desired, the IFH may be replaced by a more traditional percussion head for igniting the detonation cord 14 by such means as a falling rod that impacts a detonation hammer.

Operation

With respect to FIG. 1, the in-running set of the tool is with the gun 10 assembled with the connection module 20 and secured to the socket cylinder 22 by a radial extension of the lower latching dogs 50 beyond the inside radius of the lower latching collar 51. Here, the expanded position of the latching dogs 50 is maintained by the subjacent support of the lower latch piston 54. The axial position of the lower latch piston 54 is secured by the shear pin 56. Weight of the gun 10 is directly carried by the latching dogs 50 and the latching collar 51.

In this example, the assembly comprising the gun 10 and connecting module 20 are suspended at the end of a wireline that is connected to the connecting module 20 by means of a running tool 12.

Figure 2:
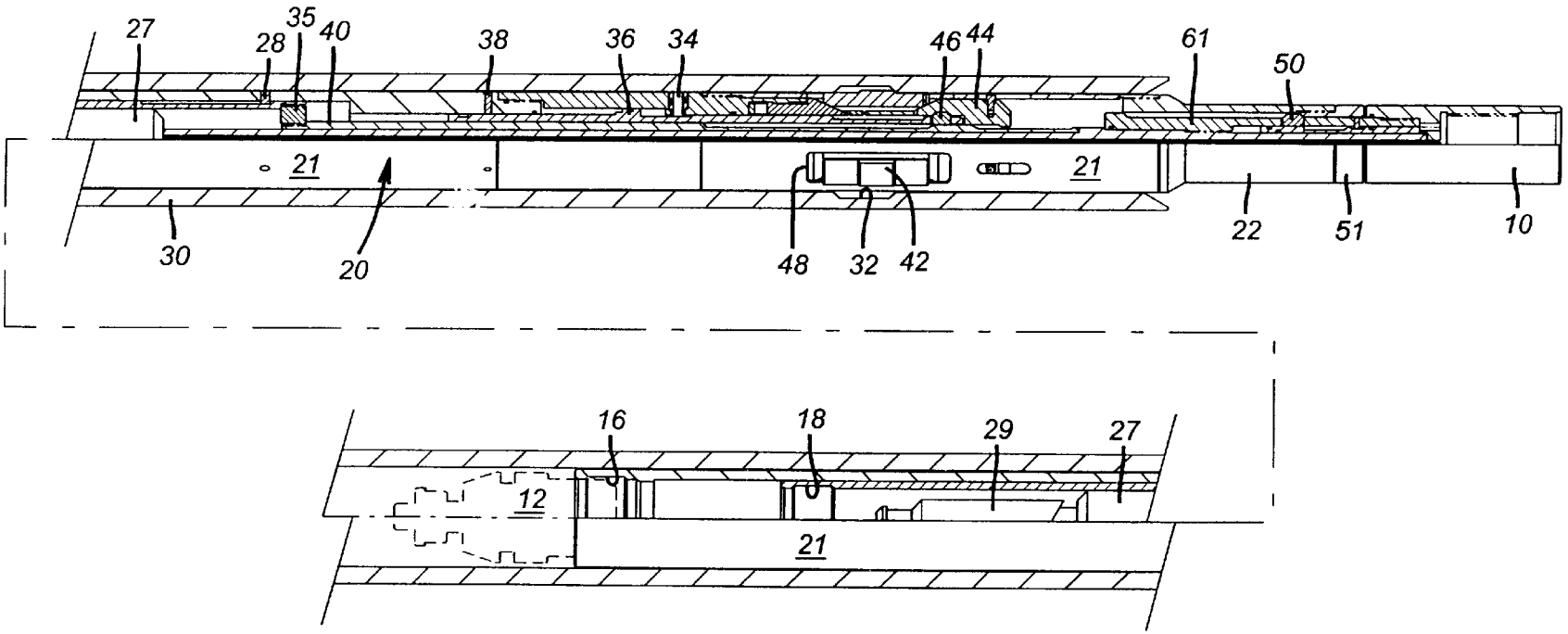
FIG. 2 is the invention assembly in the hydraulic set configuration.

Referring next to FIGS. 2 and 7, at some point down hole, the pressure differential across the rupture disc 34 will exceed the disc capacity. This may occur as the hydrostatic head of the wellbore or as a consequence of external pressure from surface sources.

When pressure admitted by the rupture disc 34 against the setting piston 36 reaches a predetermined value, the shear pin 38 is calibrated to fail. Such shear pin failure is followed by a translation of the setting piston 36.

Translation of the setting piston from the run-in position pulls the latch cone 44 against the shear pins 59. Failure of the shear pins 59 allows slip face 49 of the latch cone 44 to be drawn under and radially displace the upper latch dogs 42. This hydrostatic pressure induced force on the dog 42 radial displacement is a standing bias that holds the latch dogs 42 against the inside borewall of this completion tube. When aligned with the latching channel 32 of the completion tube borewall 30, the upper latching dogs 42 mesh with the channel 32 to secure the gun assembly at the designated axial position within the completion tube bar length. This will be the normal position of the gun 10 relative to the completion tube 30 and the position at which the gun is discharged.

Upon discharge, gun propellant combustion gas is channeled through conduits 66 against the end face of the latch piston 54 to translate the reduced diameter channel zone 58 of the latch piston surface into radial alignment with the lower latching dogs 50. This change in radial support under the latching dogs 50 permits radial contraction of the latching dogs 50 inside of the latch collar 51 inner bore. Release of the latch dog bearing on the latch collar 51 allows the gun weight to axially shift the gun 10 and stinger 23 relative to the connection module 20.

Figure 3:
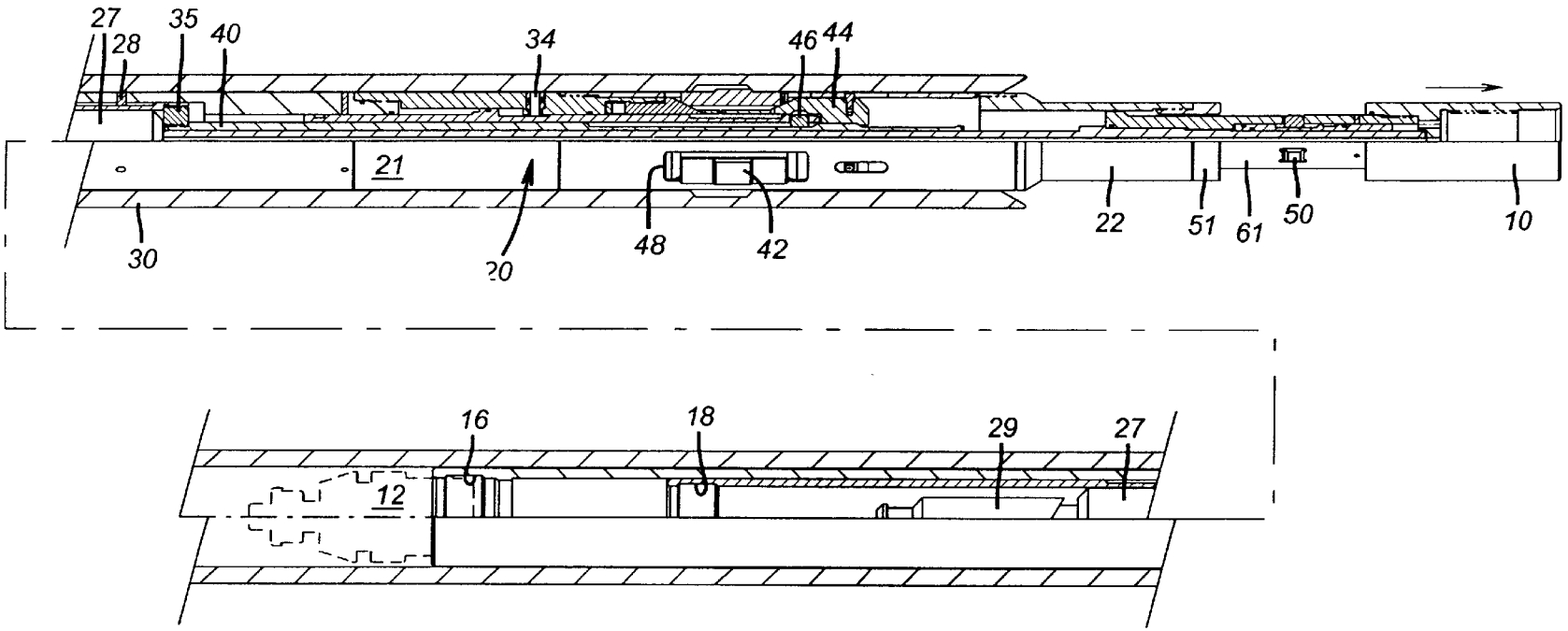
FIG. 3 is the invention assembly configured to the first step of the automatic release operational mode.

This axial shift of the stringer 23 draws the lower shoulder 31 of the IFH into engagement with the spacing collar 35 as illustrated by FIG. 3.

Figure 4:
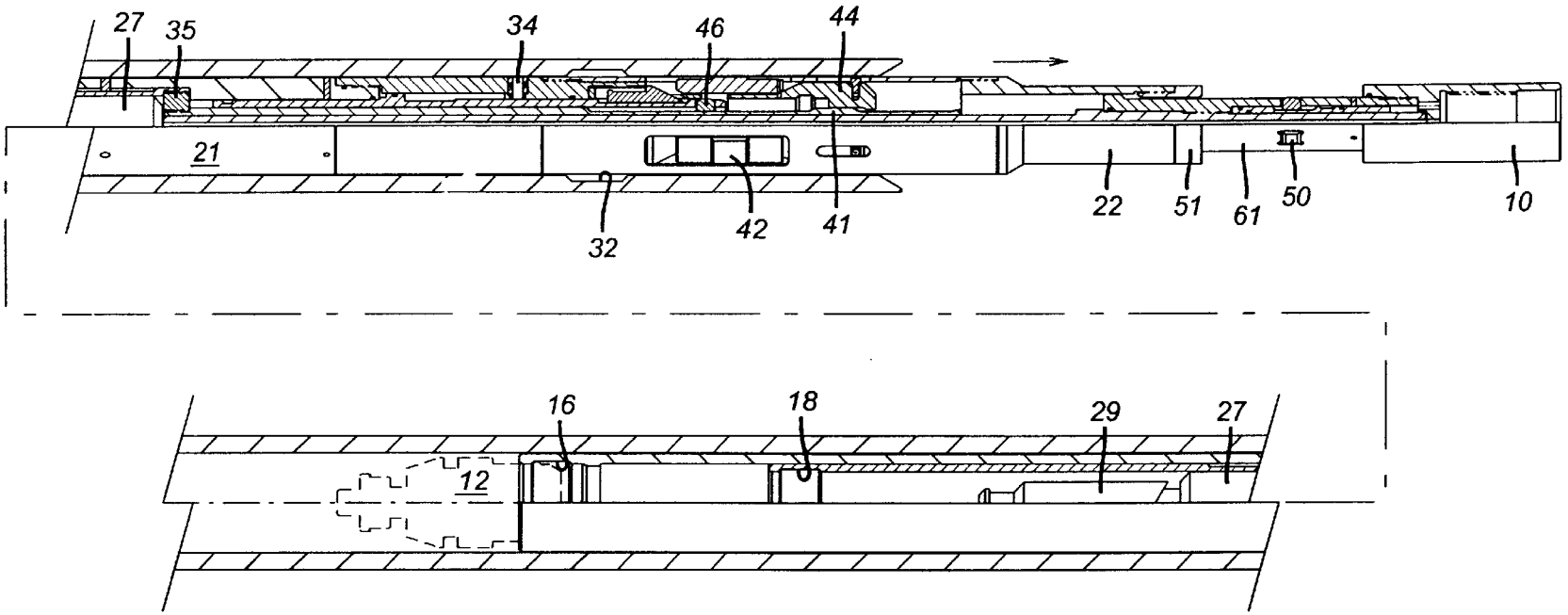
FIG. 4 is the invention assembly configured to the second step of the automatic release operational mode.

As further consequence of the axial shift within the connection module 20, the gun weight 10, applied by the IFH shoulder 31 against the spacing collar 35, translates the stinger latching profile 41 from subjacent support of the upper latch pins 46. As illustrated by FIG. 4, loss of subjacent support by the latching profile 41 allows the upper latch pin 46 to withdraw from engagement with the upper latch cone 44. Without the latch pin 46 engagement, the latch cone 44 is allowed to translate axially from support of the upper latching dog 42. Retraction of the latching dog 42 from the completion tube latching channel 32 resulantly releases the gun 10 and connection module 20 from the completion tube 30.

Unless a wireline is connected, the assembly is now free to fall from the completion tube bore. If the assembly is connected to a surface link, such as a wireline, the spent gun assembly may also be removed along the completion tube to the surface.

Figure 5:
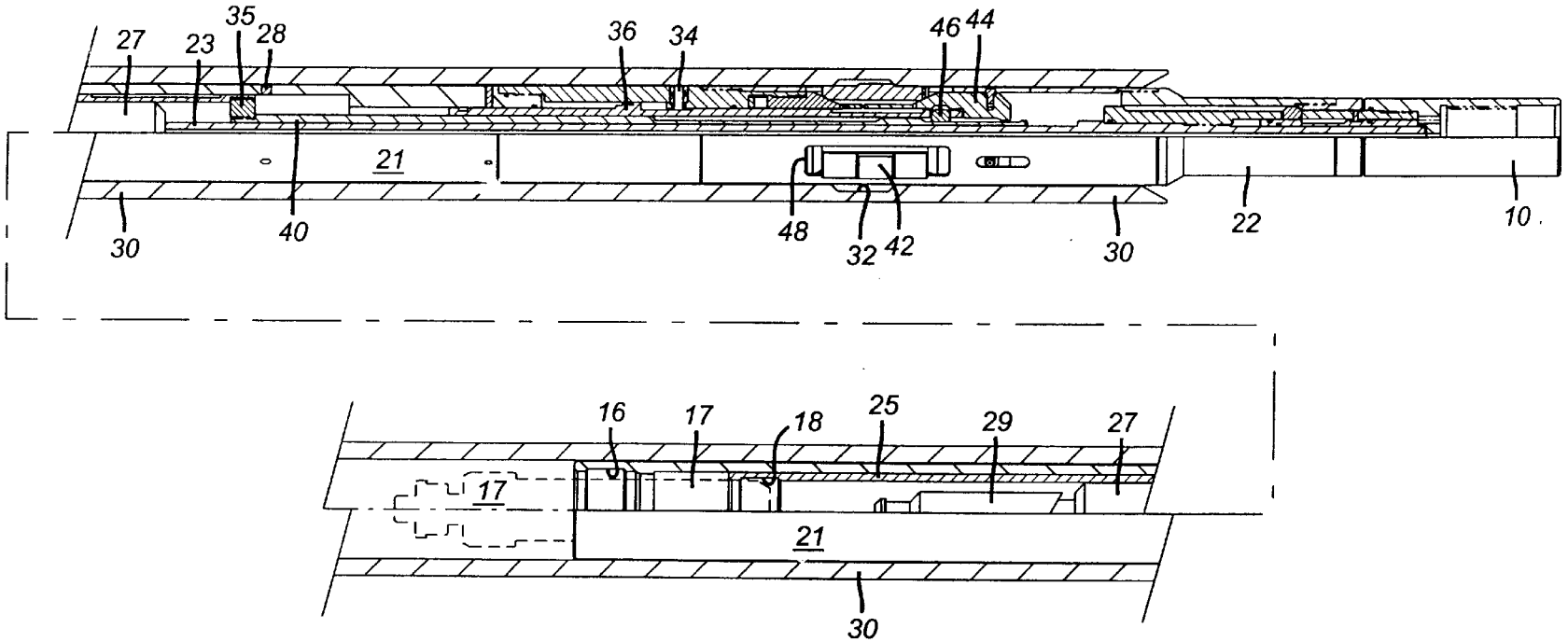
FIG. 5 is the invention assembly configured to the first step of the wireline release operational mode.
Figure 6:
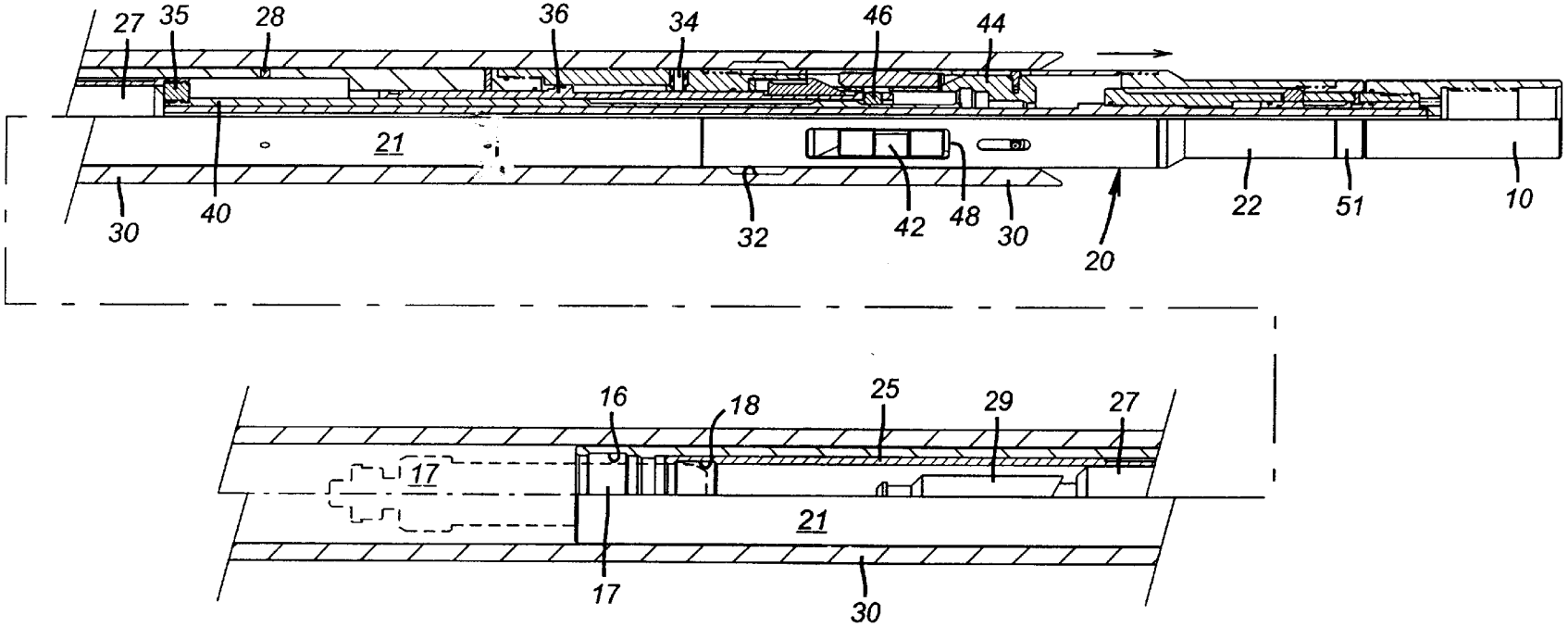
FIG. 6 is the invention assembly configured to the second step of the wireline release operational mode.

The manual mode for mechanically disconnecting a gun and connection module assembly from a completion tube is illustrated by FIGS. 5 and 6. With respect to FIG. 5, a wireline running tool 17 is aligned in the tool bore and secured to the release sleeve 25 by the wireline connection profile 18.

Tension is drawn on the wireline to axially translate the sleeve 25 toward the surface direction. Uphole translation of the release sleeve 25 is normally limited by the meshed cooperation of the shear pin 28 and key slot 26. However, with the upper latch dogs 42 meshed with the completion tube latch channel 32, sufficient tension may be drawn on the release sleeve 25 to shear the pins 28 and displace the latch pin support profile 41 portion of the integral latch profile tube 40 from support alignment with the upper latch pin 46. Retraction of the latch pin 46 releases the latch cone 44 from support of the latch dogs 42. As previously described, release of the upper latch dogs 42 has the consequence of releasing the connection module 20 from the completion tube 30.

FIG. 6 illustrates the downhole extraction of the gun and connection tube assembly 20 from the completion tube 30 which is an option after a wireline disconnect. Tension is drawn on the wireline to release the upper latching dogs 42 from the latching windows 48. Once released, the tool line may be displaced in either direction. Consequently, the gun and connecting module assembly may be released by the wireline running tool 17 and allowed to fall from the completion tube bore as indicated by FIG. 6. Conversely, the entire assembly may be drawn to the surface. If the gun has malfunctioned, the defect may be repaired or replaced and the assembly returned to the firing position without disturbing the remainder of the completion tube or any of the tools therein.

Although our invention has been described in terms of specified embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A connection assembly for releasably securing an explosive well tool to a detent profile within a tubing string, said assembly comprising a first latching assembly for meshing a latch dog with said detent profile, a second latch mechanism for retaining an explosive well tool at a first axial position in said connection assembly relative to said first latching assembly and a second latch release mechanism for releasing said explosive well tool to a second axial position in said connection assembly responsive to an explosive discharge of said well tool, said second latch mechanism engaging latch dog release means at said second axial position to extract said latch dog from said detent profile.

2. A connection assembly as described by claim 1 having in situ fluid actuating means for imposing a bias on said latch dog to mesh with said detent profile.

3. A connection assembly as described by claim 2 wherein said in situ fluid actuating means comprises a fluid entry orifice for hydrostatic well pressure.

4. A connection assembly as described by claim 3 wherein fluid flow through said fluid entry orifice is controlled by calibrated rupture means.

5. A connection assembly as described by claim 1 wherein said latch dog release means comprises wireline connection means whereby said latch dog release means may be alternatively engaged by a wireline to release said latch dog from said detent profile.

6. A connection assembly as described by claim 1 wherein said second latch mechanism comprises a retaining pin for releasably confining said well tool at said first axial position, said retaining pin being displaced by gas pressure from said explosive discharge.

7. A connection assembly as described by claim 6 wherein said meshing of said latch dog with said detent profile is secured by a first surface profile on said latch dog release means.

8. A connection assembly as described by claim 7 wherein said latch dog is withdrawn from said detent profile by displacement of said first surface profile in either of opposite directions.

9. A connection assembly as described by claim 8 wherein said first surface profile is displaced in a first direction by a shift of said well tool to said second axial position.

10. A connection assembly as described by claim 9 wherein said latch dog release means is engaged by a wireline to displace said first surface profile in a second direction.

11. A method of perforating a well casing comprising the steps of:

a) securing a perforating gun to a connector module by means of a latch mechanism;

b) setting said latch mechanism at a first of at least two set positions, said first position for securing an anchor dog within a tubing bore detent profile;

c) securing said connector module and perforating gun to a well work string tube by meshing said anchor dog with a detent profile in a work string tube bore;

d) positioning an assembly of said gun, said connector module and said well work string at a desired well depth;

e) discharging said perforating gun; and f) channeling combustion gas from said gun discharge to release said latch mechanism from said first set position and thereby release said anchor dog from the detent profile of said well work string.

12. A method as described by claim 11 wherein said anchor dog may be released from said detent profile by wireline tension.

13. A method as described by claim 12 wherein a subassembly of said connector module and gun are removed by wireline from said work string along the length of said tube bore.

14. A method as described by claim 11 wherein hydrostatic well pressure forces said anchor dog against said work string tube.

15. A method as described by claim 14 wherein said hydrostatic well pressure is applied against said anchor dog proximate of a predetermined depth of said detent profile within said well.

16. A well perforation assembly comprising:

a) a well perforation gun having a plurality of combustion gas generating perforation charges; and, b) a tubing connector having a gun connecting mechanism and a tube connecting mechanism, said tube connecting mechanism comprising a detent latching dog, said gun connecting mechanism having a first set position that secures an engagement position of said latching dog in a detent profile in the inside bore wall of a well tube and a second set position that releases said latching dog from said detent profile engagement position.

17. A well perforation assembly as described by claim 16 wherein said gun connecting mechanism comprises a latching pin that is released from said first set position by a combustion gas displaced piston element.

18. A well perforation assembly as described by claim 16 wherein said gun connecting mechanism is biased to said second set position when released from said first set position.

19. A well perforation assembly as described by claim 16 wherein said tube connecting mechanism comprises a connection profile for receiving a wireline running tool to alternatively release said tube connecting mechanism from said well tube engagement position.

20. A well perforation assembly as described by claim 16 wherein said tube connecting mechanism is displaced to said well tube engagement position by hydrostatic well pressure.

21. A well perforation assembly as described by claim 20 wherein said hydrostatic well pressure is applied to said tube connecting mechanism through a calibrated rupture disc.

* * * * *